United States Patent [19]

Kawada

[11] 4,453,275

[45] Jun. 12, 1984

[54] GOLF GLOVE

[76] Inventor: Toshiyuki Kawada, 360, Matsubara, Shirotori-cho, Okawa-gun, Kagawa, Japan

[21] Appl. No.: 386,418

[22] Filed: Jun. 8, 1982

[30] Foreign Application Priority Data

Sep. 25, 1981 [JP] Japan ..... 56-142759

[51] Int. Cl.[3] ..... A41D 19/00

[52] U.S. Cl. ..... 2/161 A; 2/163; 2/169

[58] Field of Search ..... 2/161 A, 161 R, 169, 2/163

[56] References Cited

U.S. PATENT DOCUMENTS

| | | | |
|---|---|---|---|
| 2,227,586 | 6/1941 | Johnson | 2/169 |
| 3,548,414 | 3/1969 | Fujita | 2/169 |
| 4,051,552 | 11/1977 | Widdemer | 2/161 A |

FOREIGN PATENT DOCUMENTS

| | | | |
|---|---|---|---|
| 138879 | 4/1934 | Austria | 2/169 |
| 852107 | 10/1939 | France | 2/169 |

*Primary Examiner*—Werner H. Schroeder
*Assistant Examiner*—Tracy Graveline
*Attorney, Agent, or Firm*—Wenderoth, Lind & Ponack

[57] ABSTRACT

An improved golf glove in which the wearer can grip a golf club more firmly. The palm portions of the fingers are made to be shorter than the back portions and the palm portion of only the thumb portion is longer than its back portion.

3 Claims, 6 Drawing Figures

GOLF GLOVE

BACKGROUND AND SUMMARY OF THE INVENTION

The present invention relates to a glove for use in playing golf.

An object of the present invention is to provide a golf glove with which the wearer can grip a golf club more firmly for more satisfactory and comfortable play.

In accordance with the present invention, the thumb portion of the golf glove is cut to bend rearweardly away from the other fingers and the other finger portions are adapted to bend forwardly, the least for the index finger and the most for the little finger.

Other features and objects of the present invention will become apparent from the following description taken with reference to the accompanying drawings; in which:

DETAILED DESCRIPTION OF THE INVENTION

Figure 1:
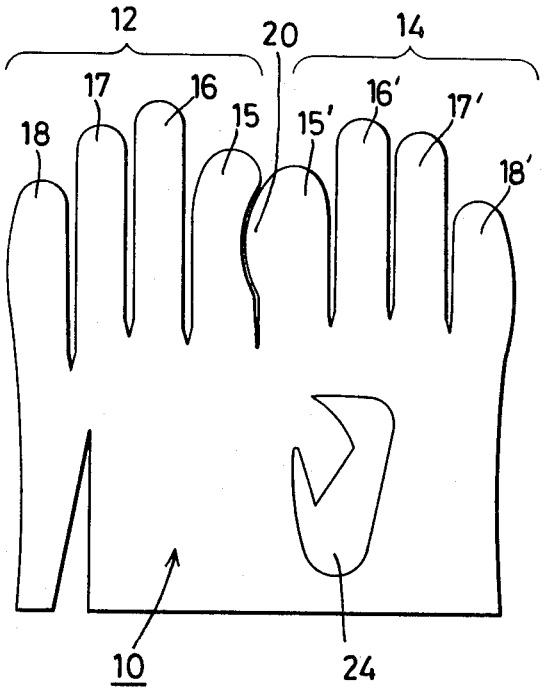
FIG. 1 is a plan view of the back and palm portions of the golf glove embodying the present invention prior to sewing.

Referring first to FIG. 1, the golf glove generally designated by numeral 10 has a back portion 12 and a palm portion 14 integral with each other. The back portion 12 has four finger portions, i.e. an index finger portion 15, a middle finger portion 16, a ring finger portion 17 and a little finger portion 18. The palm portion 14 has corresponding portions 15', 16', 17' and 18' to be sewn to the finger portions 15, 16, 17 and 18 of the back portion.

The finger portions 15', 16', 17' and 18' of the palm portion are cut to be shorter than the finger portions 15, 16, 17 and 18 of the back portion, respectively, so that the wearer of the glove will grip a golf club more firmly.

Figure 4:
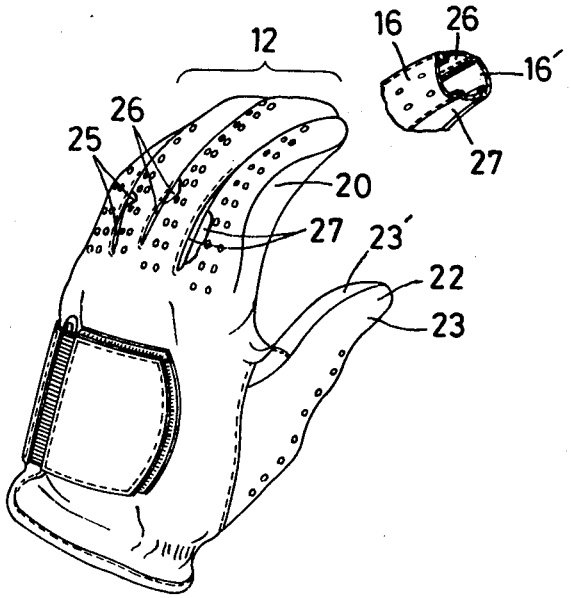
FIG. 4 is a partially cutaway schematic view of the golf glove in accordance with the present invention.

The index finger portion 15' of the palm portion 14 is provided with an extending portion 20 projecting sidewise toward the index finger portion 15 of the back portion 12. The index finger portions 15 and 15' are separated by a cut extending the full lengths thereof, substantially the same length as the cut between finger portions 15 and 16, the index portions being sewn together along the cut to form a seam, as shown in FIG. 1, the cut being joined as illustrated in FIG. 4. The provision of the extending portion enables the wearer of the golf glove to grip a golf club more comfortably with the seam between the index finger portions not resting on the golf club.

Figure 2:
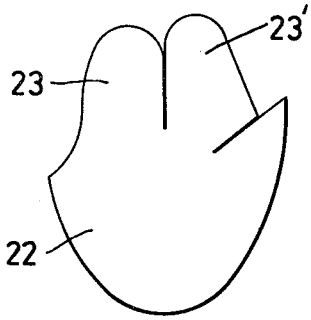
FIG. 2 is a plan view of the thumb portion prior to sewing.

The material 10 cut for the golf glove is formed in the palm portion with an opening 24 for the thumb portion to which a thumb portion 22 is sewn. The shape of the opening is such that no wrinkle is formed on the palm portion. The thumb portion has a back part or portion 23 and a palm part or portion 23' which is cut to be longer than the back part or portion 23 so that the thumb will bend back away from the golf club and the other fingers. The cut between the palm and back portions of the thumb portion extends substantially the full length of the back and palm portions of the thumb portions, as shown in FIGS. 2 and 4.

Figure 3A:
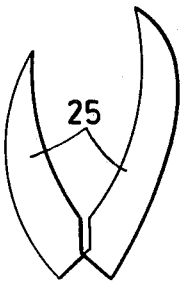
FIG. 3*a* is a plan view of the fourchette for between the little and ring fingers.
Figure 3B:
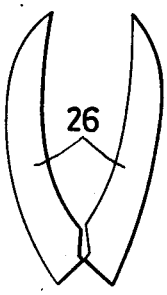
FIG. 3*b* is a plan view of the fourchette for between the ring and middle fingers.
Figure 3C:
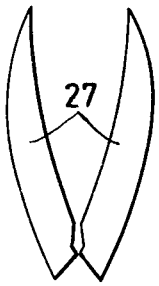
FIG. 3*c* is a plan view of the fourchette for between the middle and index fingers.

The finger portions of the back portion are sewn to those of the palm portion through fourchettes shown in FIGS. 3*a*, 3*b* and 3*c*. The fourchettes 25 of FIG. 3*a* are used between the little finger and the ring finger. Fourchettes 26 of FIG. 3*b* are used between the ring finger and the middle finger. Fourchettes 27 of FIG. 3*c* are used between the middle finger and the index finger.

With the arrangement in accordance with the present invention, it will be understood from the foregoing that the wearer of the golf glove according to the present invention feels more snuggness when gripping a golf club because the finger portions bend more easily to grip the golf club. The golf glove enables the wearer to grip the golf club more firmly.

What I claim is:

1. A golf glove comprising:

a back portion having a plurality of finger portions including an index finger portion, a middle finger portion, a ring finger portion and a little finger portion;

a palm portion having a plurality of finger portions including an index finger portion, a middle finger portion, a ring finger portion and a little finger portion and being formed with an opening for a thumb portion, said finger portions of the palm portion being shorter in length than the finger portions of the back portion to facilitate the bending of the fingers of the wearer when gripping a golf club, said finger portions of the palm portion being joined to said finger portions of the back portion, a sewn together index finger cut being formed along the edges of and between the index finger portion of said palm portion and the index finger portion of said back portion, said index finger cut extending substantially the full length of the finger portion of at least one of said palm portion and said back portion;

a plurality of fourchettes sewn to both edges of the ring finger portions and the middle finger portions of said back and palm portions and to the inner edge of the little finger portions and the index finger portions of said back and palm portions; and a thumb portion having a back part and a palm part, said back part being shorter in length than said fi part so that said thumb portion bends rearwardly away from the other fingers and the golf club when gripping the golf club, said thumb portion being sewn to said palm portion in said opening, a sewn together thumb cut being formed between the palm part of said thumb portion and the back part of said thumb portion, said thumb cut extending substantially the full length of at least one of the back part and the palm part of said thumb portion.

2. A golf glove as defined in claim 1, wherein said index finger portion of the palm portion has a portion extending toward the index finger portion of the back portion.

3. A golf glove as defined in claim 1, wherein a sewn middle finger cut is formed between the middle finger portion of said back portion and the index finger portion of said back portion, said index finger cut being substantially the same length as said middle finger cut.

* * * * *